US005922376A

United States Patent [19]

Privert

[11] Patent Number: 5,922,376

[45] **Date of Patent: *Jul. 13, 1999**

[54] NESTABLE FOOD AND BEVERAGE PACKAGE

[76] Inventor: Peter Privert, 1525 Vest Dr., Naperville, Ill. 60563

[ * ] Notice: This patent issued on a continued prosecution application filed under 37 CFR 1.53(d), and is subject to the twenty year patent term provisions of 35 U.S.C. 154(a)(2).

[21] Appl. No.: 08/772,390

[22] Filed: Dec. 23, 1996

Related U.S. Application Data

[60] Provisional application No. 60/009,475, Jan. 2, 1996.

[51] Int. Cl.[6] ..... A21D 10/02; B65D 73/00

[52] U.S. Cl. ..... 426/120; 426/115; 426/106; 206/461

[58] Field of Search ..... 206/45.18, 542, 206/461, 545, 518, 515, 740, 742, 765, 511, 505; 426/120, 112, 115, 114, 119

[56] References Cited

U.S. PATENT DOCUMENTS

| | | | |
|---|---|---|---|
| D. 224,585 | 8/1972 | Jewell | D9/185 |
| D. 224,586 | 8/1972 | Boord | D10/64 |
| D. 265,551 | 7/1982 | Colby et al | D9/415 |
| D. 282,821 | 3/1986 | Noyes | D9/415 |
| D. 305,204 | 12/1989 | Reifein et al. | D9/418 |
| D. 305,205 | 12/1989 | Grindrod et al. | D9/418 |
| 2,950,040 | 8/1960 | Bolding | 229/38 |
| 2,965,501 | 12/1960 | Harriss | 99/192 |
| 3,037,677 | 6/1962 | Debs | 229/5.6 |
| 3,115,245 | 12/1963 | Schechter | 206/56 |
| 3,292,810 | 12/1966 | Schechter | 220/4 |
| 3,373,045 | 3/1968 | Peterson | 99/171 |
| 3,401,863 | 9/1968 | Earl | 229/2.5 |
| 3,443,681 | 5/1969 | Wysocki | 206/46 |
| 3,451,612 | 6/1969 | Sinoto | 229/38 |
| 3,487,915 | 1/1970 | Scott | 206/46 |
| 3,586,235 | 6/1971 | Fishel | 232/35 |
| 3,651,928 | 3/1972 | Weisman | 206/45.14 |
| 3,785,546 | 1/1974 | Kuster | 229/53 |
| 3,796,366 | 3/1974 | Hahn | 229/1.5 B |
| 3,903,309 | 9/1975 | Mahaffy et al. | 426/129 |
| 3,933,296 | 1/1976 | Ruskin et al. | 229/2.5 |
| 4,146,128 | 3/1979 | Hogg et al. | 206/45.19 |
| 4,233,367 | 11/1980 | Ticknor et al. | 428/476.3 |
| 4,240,522 | 12/1980 | Spear et al. | 182/105 |
| 4,346,833 | 8/1982 | Bernhardt | 229/43 |
| 4,355,721 | 10/1982 | Knott, II et al. | 206/524.2 |
| 4,355,755 | 10/1982 | Faller | 229/2.5 R |

(List continued on next page.)

FOREIGN PATENT DOCUMENTS

| | | |
|---|---|---|
| 0 273 840 A2 | 7/1988 | European Pat. Off. . |
| 0 441 666 A2 | 8/1991 | European Pat. Off. . |
| 2 553 215 | 4/1985 | France . |
| 31 10847 A1 | 9/1982 | Germany . |

*Primary Examiner*—David Lacey
*Assistant Examiner*—Drew Becker
*Attorney, Agent, or Firm*—McAndrews, Held & Malloy, Ltd.

[57] ABSTRACT

A compartmentalized food and beverage package is disclosed which is sufficiently rigid to withstand typical loads occasioned by conventional shipping, yet minimizes materials and is highly functional. The present container is also capable of being stood upright on an edge thereof for consumer impact. These advantages are provided by a container comprising a generally rectangular tray having flanges defining recessed food receiving compartments. At least one of the compartments being of sufficient size to accommodate a beverage wherein the weight of the beverage permits the container to be stood upright on a base defined by the beverage compartment and the lower edge of the tray.

21 Claims, 3 Drawing Sheets

U.S. PATENT DOCUMENTS

| | | | |
|---|---|---|---|
| 4,382,513 | 5/1983 | Schirmer et al. | 206/484 |
| 4,405,667 | 9/1983 | Christensen et al. | 428/35 |
| 4,444,827 | 4/1984 | Swaroop | 428/216 |
| 4,537,305 | 8/1985 | Takanashi | 206/438 |
| 4,570,818 | 2/1986 | Borst et al. | 220/339 |
| 4,669,611 | 6/1987 | Flaherty | 206/442 |
| 4,701,360 | 10/1987 | Gibbons et al. | 428/35 |
| 4,711,356 | 12/1987 | Dunden | 206/503 |
| 4,944,603 | 7/1990 | Cornish et al. | 383/5 |
| 4,961,494 | 10/1990 | Alexander | 206/45.2 |
| 5,011,006 | 4/1991 | Anderson | 206/45.24 |
| 5,042,652 | 8/1991 | Grindrod | 206/45.34 |
| 5,119,940 | 6/1992 | Grindrod | 206/45.31 |
| 5,167,973 | 12/1992 | Snyder | 426/115 |
| 5,375,701 | 12/1994 | Hustad et al. | 206/45.18 |

NESTABLE FOOD AND BEVERAGE PACKAGE

CROSS-REFERENCE TO THE RELATED APPLICATIONS

This application is related to and claims priority benefits from U.S. Provisional Patent Application Serial No. 60/009,475 filed Jan. 2, 1996, entitled "FOOD PACKAGE". The '475 provisional application is incorporated herein by reference in its entirety.

STATEMENT REGARDING FEDERALLY SPONSORED RESEARCH OR DEVELOPMENT

Not applicable.

BACKGROUND OF THE INVENTION

The present invention relates generally to packages and, more particularly, to a compartmentalized tray for food or other objects.

Food packages are known which are hermetically sealed and contain various food items in compartments which are visible or partially visible to the consumer. However, when such packages are to be shipped through the ordinary channels of commerce from the original manufacturer to the grocery store shelf, the package must provide, in addition to its sealing and carrying functions: a way to attach one or more labels providing information to the consumer, a way to stand upright on one edge, and a way to preserve the structural integrity of the package during shipping and handling.

It is important that the product be able to stand upright on edge to provide "shelf presence" for the product, while presenting the labeling information to the consumer. In order to improve the shelf presence of a product, it is desirable to maximize the surface area of the product confronting potential purchasers.

Heretofore, in a container of the present type, these additional functions have been provided by an outer closure, container, or carton such as shown in U.S. Pat. Nos. D-305,204 and D-305,205, or a rigid back panel as claimed in U.S. Pat. No. 5,375,701.

While desirable from a sales and marketing standpoint, the use of an outer carton or back panel considerably increases the cost of the overall package. Moreover, the additional packaging material is oftentimes negatively perceived by the consumer as costly and wasteful excess.

Consumers also demand that such packages contain beverages as well as food products. Beverages, however, typically require more volume than the food products which they are to be packaged with. For example, prepackaged snacks or light meals may contain a beverage carton as well as crackers and cheese. The associated bulk of the beverage compartment highlights the shortcomings of present compartmentalized food containers. Present food containers do not address the material cost increase or loss of shipping space associated with such food containers having an oversized beverage compartment with respect to the remaining food compartments. To enclose such a tray with an outer container or carton creates unnecessary waste. Thus, there exists a need for a combined food and beverage container minimizing materials, yet having structural stability when stacked, and spatial efficiency when shipped.

BRIEF SUMMARY OF THE INVENTION

The present invention is directed to overcoming one or more of the above-noted problems. Accordingly, an object of the present invention is to provide a sufficiently rigid food and beverage container to withstand typical loads occasioned by conventional shipping and handling.

It is another object of the present invention to provide a food and beverage container capable of being stood upright on its edge for consumer impact.

It is yet another object of the present invention to provide a food and beverage container which minimizes materials and is highly functional.

Another object of the present invention is to provide a food and beverage container which can be stacked, or nested, on its major surfaces with minimal use of space during shipping in conventional multiple unit case packing.

The above and other objects and advantages of the invention are provided by a container comprising a generally rectangular tray having internal and peripheral flanges defining recessed food receiving compartments. The flanges are of sufficient width for sealing a flexible film thereto. At least one of the compartments of the tray may contain a beverage. The beverage compartment is a generally rectangular recess formed adjacent the lower edge and one of the side edges. The beverage compartment further has a recess designed so that the weight of the contained beverage permits the container to be stood upright upon the base defined by the recess and lower edge of the tray.

A further aspect of the invention is a container having front and back surfaces. The front surface has integral recessed compartments which project from the back surface. The back surface is configured so the container can be nested with a second, optionally identical container when the containers are positioned back to back.

BRIEF DESCRIPTION OF THE SEVERAL VIEWS OF THE DRAWING

For a more complete understanding of this invention, reference should now be had to the embodiment illustrated in greater detail in the accompanying drawings and described below by way of example of the invention.

In the drawings.

Figure 1:
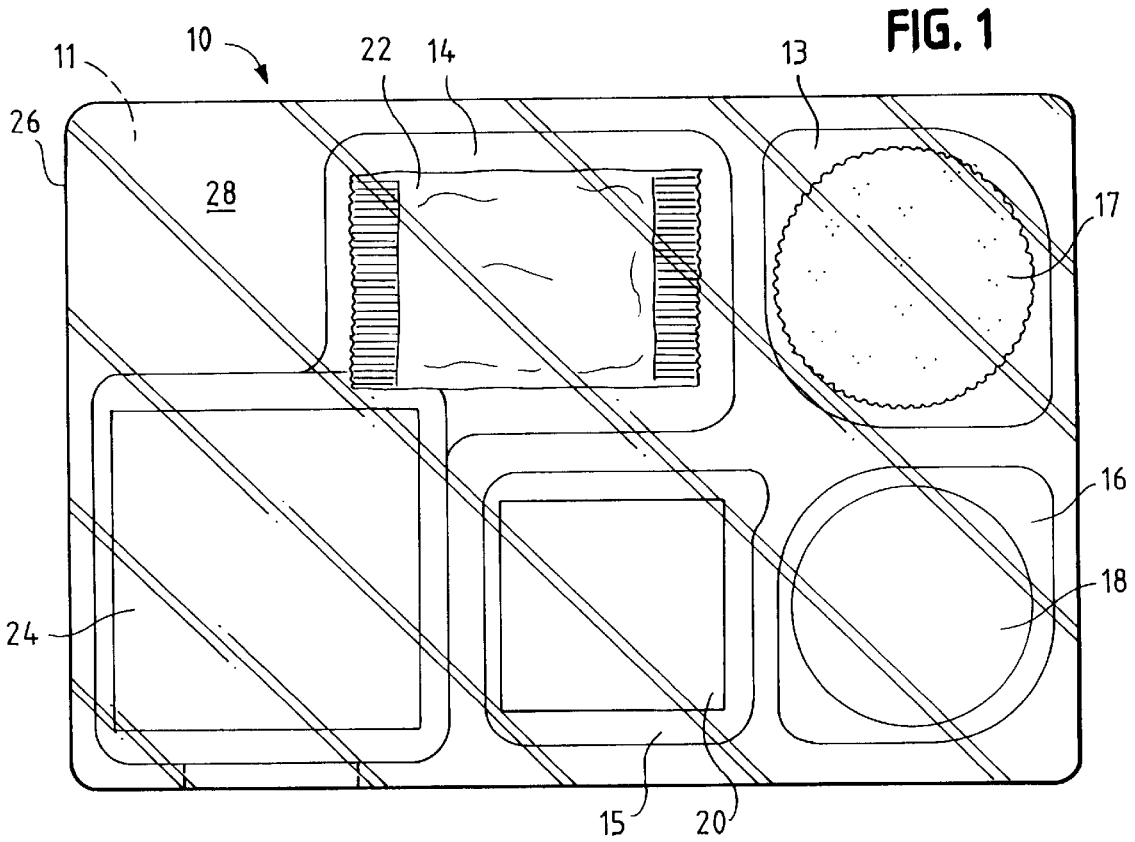
FIG. 1 is a front elevation view of the packed and sealed container of the present invention, standing on edge so the illustrated surface is substantially vertical.

The following reference characters are used in the Figures.

10 Container
11 Front surface
12 Back surface
13 Compartment
14 Compartment
15 Compartment
16 Compartment
17 Crackers
18 Meat
20 Cheese
22 Candy

24 Beverage
26 Tray
28 Film
30 Lower edge
32 Upper edge
34 Side edge
35 Side edge
36 Peripheral flange
38 Internal flange
40 Side wall
41 Side wall
42 Side wall
43 Beverage compartment
44 Projection
45 Side wall
46 Recess

DETAILED DESCRIPTION OF THE INVENTION

In the following detailed description, spatially orienting terms are used such as "left," "right," "vertical," "horizontal," and the like. It is to be understood that these terms are used for convenience of description of the preferred embodiments by reference to the drawings. These terms do not necessarily describe the absolute location in space, such as left, right, upward, downward, etc., that any part must assume.

Referring now to the drawings, FIG. 1 shows a front elevation of one embodiment of the container of the present invention, standing on edge. The container 10 is adapted to store a variety of food products in separate compartments 13, 14, 15, 16. For example, a compartment 13 could contain a farinaceous product such as crackers 17; a proteinaceous product such as meat 18 or cheese 20; a sugar product such as candy 22 or the like; and a beverage 24 such as a juice carton.

The container 10 is preferably generally rectangular and comprises a compartmentalized tray 26 which may be covered by a flexible film 28.

Figure 2:
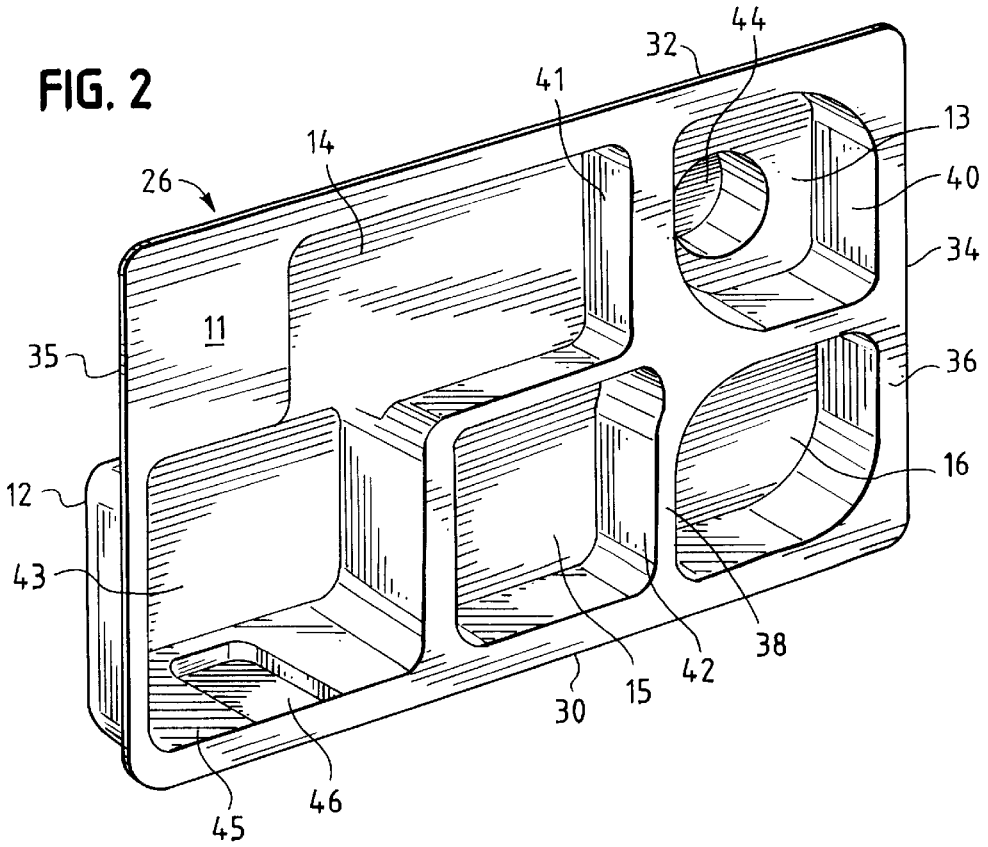
FIG. 2 is an isolated perspective view of the tray shown in FIG. 1.

FIG. 2 is an isometric view of the tray of FIG. 1. As shown in FIG. 2, the tray 26 comprises a lower edge 30, an upper edge 32, side edges 34, 35, and peripheral and internal flanges 36, 38. Flanges 36, 38 are located in the uppermost reference plane or front surface 11 of the tray 26. Peripheral flanges 36 surround the outer periphery of the tray 26. Internal flanges 38 divide the tray 26 into recessed compartments 13, 14, 15, 16. Each compartment 13, 14, 15, 16 of the tray 26 is defined by side wall surfaces 40, 41, and 42 extending down from the flanges 36, 38 to form a recess which may receive a food product.

The tray 26 is preferably molded from a single or laminated sheet of material such as acrylonitrile copolymer, polyester, polystyrene, polypropylene, polyvinyl chloride, or polyester copolymers.

As shown in FIG. 2, the beverage compartment 43 may be a larger recess than the other compartments 13, 14, 15, 16. Typically, the beverage compartment 43 will be larger, wider and deeper than the other compartments 13, 14, 15, 16. This is likely because a person typically consumes a greater volume and weight of a beverage in relation to the remaining food items. Also, a beverage container is typically taller than a serving of solid food. The disproportionate size of the beverage compartment 43 in relation to the remaining compartments 13, 14, 15, 16, however, requires special provisions for stacking multiple containers for shipping in conventional multiple unit case packing.

In addition, the preferred function of the present container is to provide a selection of foods and a beverage which, taken together, would form a snack or light meal to be eaten by a consumer in one sitting. To facilitate this purpose, the tray 26 is adapted to sit in a stable manner on a flat surface such as a table or the like, even though the compartments 13, 14, 15, 16, 43 are not equally deep.

Accordingly, to remedy the instability and packaging problems posed by the larger beverage compartment 43, a depressed bottom surface, or projection, 44 is provided in a compartment 13 diagonally opposite the beverage compartment 43 to stabilize the tray 26 when it is resting horizontally on a flat surface. Another factor contributing to the stability of the tray 26 is that the recess created by the beverage compartment 43 is long and wide, which provides a larger footprint relative to the other compartments 13, 14, 15, 16. Thus, when the tray 26 is oriented generally horizontally on a surface, such as on a table or the like, the tray 26 can present the contained food products in a generally level and stable format. Consistent with this presentation of the food items, another goal of the present invention is to allow the compartments 13, 14, 15, 16 to be individually sized to various depths so that the surface of each food article is at the same height relative to the front surface 11.

In the commercialization of a food product in a container of the type described, it is important that the tray be capable of being displayed in an upright condition with the front surface 11, i.e., the larger surface through which the food products are visible, located in a generally vertical plane facing the potential customer. Preferably, this is accomplished by constructing the package so that it can stand on its lower edge 30 which would engage the supporting surface when the printing on the front surface 11 is upright in the vertical plane. The package could also be supported in this upright condition by a hanging hole which permits hanging of the package from above in a display rack with hanging hooks. The preferred arrangement, however, is to construct the package so that it can stand upright on its edge 30 as shown in FIG. 2.

In accordance with the present invention, the tray 26 further includes a keel or recess 46 formed in a sidewall 45 of the beverage compartment 43 adjacent the lower edge 30 to allow the container 10 to stand on edge. The recess 44, together with the lower edge 30, define a "footprint" or base such that the center of gravity of the entire container 10 is over the footprint, allowing it to stand upright.

In the disclosed embodiment, it is preferred that the keel or recess 44 be formed in the beverage compartment 43 since the weight of the beverage 24 within the compartment 44 will insure that the center of gravity of the overall container 10 is centered over the footprint created by the recess 44 and the lower edge 30. This will act to stabilize the container 10 when it is oriented in the upright position.

In order to improve the stability of the loaded package in the upright position, it is also preferable to maintain the depth of the compartments 13, 14, 15, 16 at approximately half the depth of the beverage compartment 43. This will insure that the center of gravity of the individual compartments 13, 14, 15, 16 is near the front surface 11, and will aid in maintaining the center of gravity of the entire package over the footprint formed by the recess 44 and lower edge 30.

As shown in FIGS. 1 and 2, the beverage compartment 43 of the tray 26 may also be open along one corner to an adjacent compartment 14. Such an open configuration allows the tray 26 to accommodate food products such as candy 22 of varying sizes and forms. Specifically, something too big for either cavity 14 or 43 in one or more dimensions, such as a knife or fork, can reside in both cavities.

Figure 3:
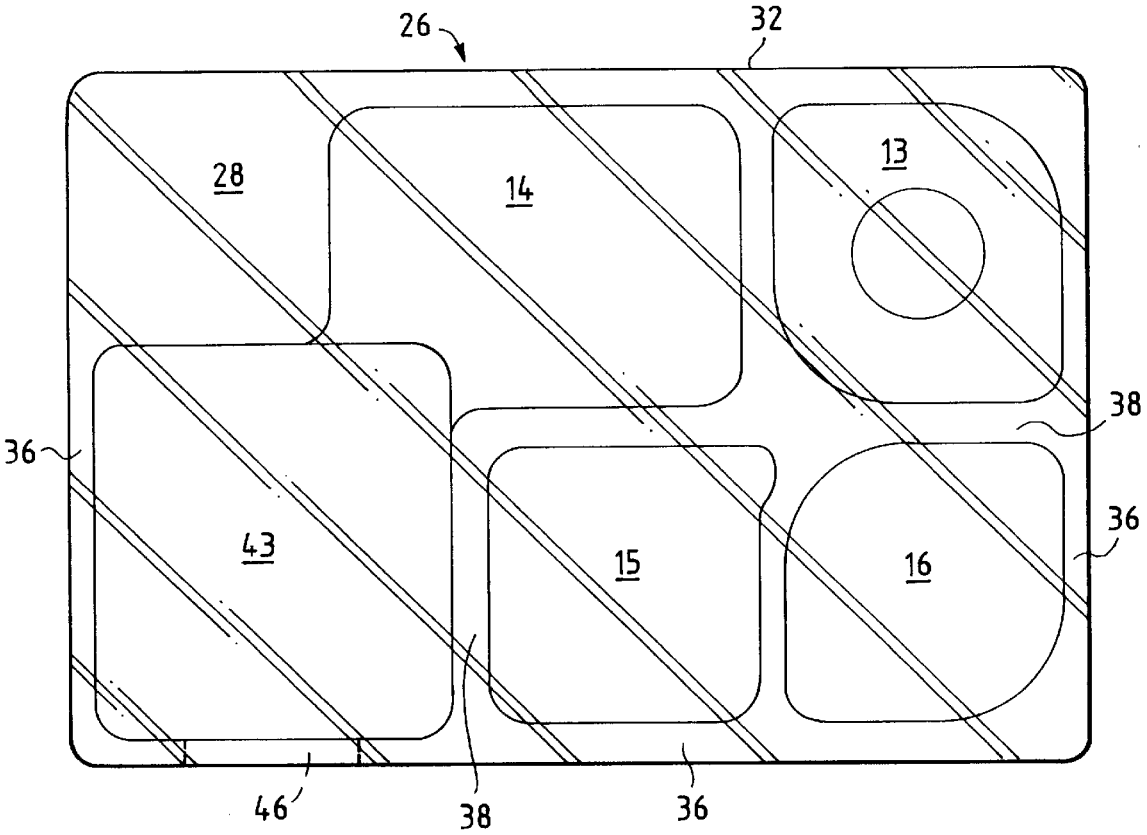
FIG. 3 is similar to FIG. 1, but shows the package unpacked.

Referring to FIG. 3, a front elevation view of the tray 26 of FIG. 1 is shown covered by a transparent flexible film 28 sealing the several compartments 13, 14, 15, 16, 43. Film 28 is preferably a multi-layer film, wherein one layer is preferably polyester, nylon, polypropylene or polyethylene, while the other layer is an adhesive layer containing an antifogging additive or coating. The film may also contain an oxygen barrier such as saran (vinylidene chloride) or an ethylene/vinyl alcohol copolymer. In addition, the film 28 preferably has an outer surface adapted to receive printing for labeling and consumer information, or in the case of a laminate film, one or more surfaces adapted to receive printing.

The film 28 is sealed to the tray 26 along the internal and peripheral flanges 36, 38. Alternatively, sealing just around the peripheral flange 36 is contemplated, as is partial sealing around some compartments and not others, within the scope of the invention. The film 28 may be sealed to the flanges 36, 38 by heat, adhesive, ultrasonic sealing, or in other ways. Preferably, the film 28 is sealed to the flanges 36, 38 to hermetically seal the respective compartments 13, 14, 15, 16, 43 from the environment and each other, and to keep the contents behind the front surface 11 even when the package is held upside down.

Figure 4:
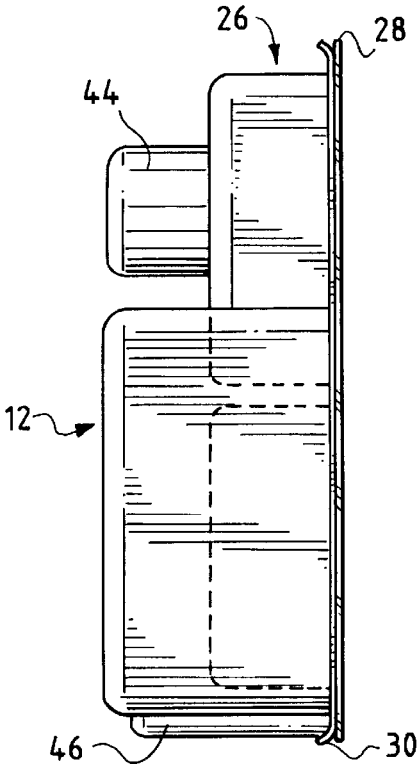
FIG. 4 is a left side elevation view of the tray of FIG. 3.
Figure 5:
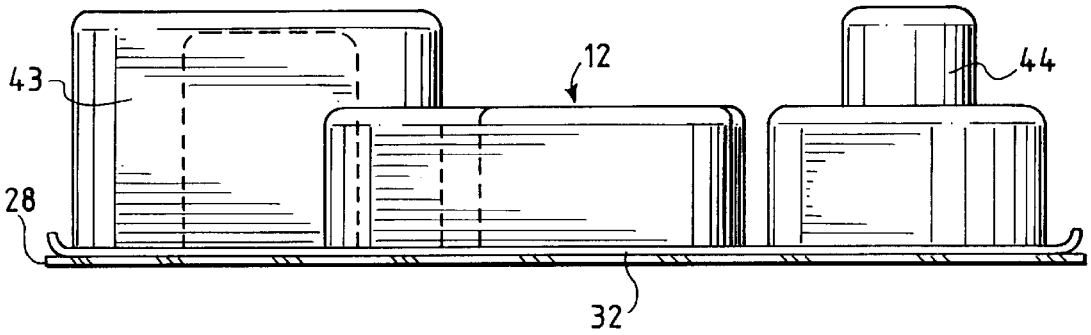
FIG. 5 is a plan view of the tray of FIG. 3.
Figure 6:
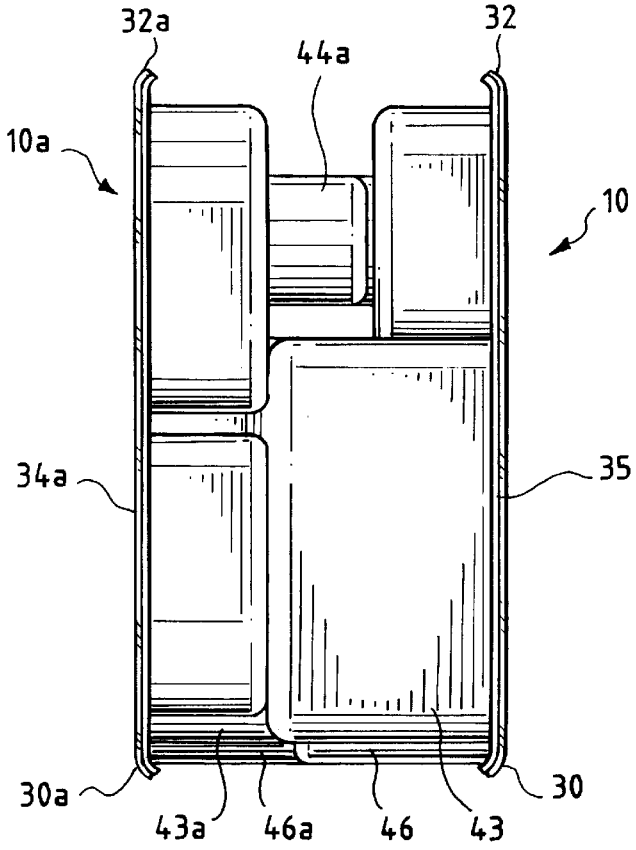
FIG. 6 is a right side elevation view of the container of FIG. 3 (on the left) nested with a second such container shown as a left side elevation view of FIG. 3 (on the right).

As shown in FIGS. 4, 5, and 6, the locations of the beverage compartment 43 and the projection 44 affect the stackability, or nesting, of multiple containers.

In order to save space during shipment of multiple containers, it is desirable that they be stackable in a secure and compact fashion within conventional multiple unit case packing.

FIG. 6 shows a side view of two containers 10 and 10*a*, such as those of FIG. 1, nested back-to-back to achieve this result. It is preferable to align the side edges 34*a*, 35, the upper edges 32, 32*a*, and the lower edges 30, 30*a* of the respective containers 10, 10*a* such that when viewed from the front elevation, the nested packages are registered as in FIG. 1. This nesting will be referred to as lateral nesting. Thus, lateral nesting is nesting in registration wherein the respective containers 10, 10*a* do not overlap in either the side elevation or plan view.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A tray comprising:

(a) a front surface for supporting articles, said front surface being circumscribed by an edge which defines a front plane;

(b) a back surface;

(c) at least first and second integral compartments formed in said front surface, projecting behind said front plane to a first depth, respectively located adjacent to one pair of diametrically opposed corners of said front surface, and neither located adjacent to two consecutive corners of said front surface, said first and second compartments being the deepest compartments in said package and defining feet on said back surface for supporting said package on a horizontal surface with said front plane generally horizontal;

(d) said back surface of said tray being configured so the first and second compartments of said tray can be nested laterally between the corresponding first and second compartments of another said tray when said trays are positioned back to back, allowing compact stacking of said trays.

2. The tray of claim 1, wherein said first compartment is sized to receive a beverage container.

3. The tray of claim 2, wherein said first compartment is sized to support a beverage container with its bottom substantially at said first depth in said first compartment.

4. The tray of claim 1, further comprising at least a third compartment which projects behind said front plane to a depth substantially less than said first depth.

5. The tray of claim 4, wherein two of said first, second, and third compartments communicate between said front plane and said front surface, said communicating compartments being so positioned that an object too big to fit in either communicating compartment in at least one dimension can be positioned behind and generally parallel to said front plane and fit within both of said communicating compartments.

6. The tray of claim 1, wherein said first compartment has a side wall which is generally perpendicular to said front plane and adjacent to said edge, said side wall defining a keel for supporting said tray with said front plane substantially vertical.

7. The tray of claim 6, wherein said second compartment is configured to support an article, having a center of gravity, so the center of gravity is disposed at less than half of said first depth from said front plane.

8. The tray of claim 7, further comprising at least a third compartment which projects behind said front plane to a depth substantially less than said first depth.

9. The tray of claim 8, wherein said third compartment is configured to support an article, having a center of gravity, so the center of gravity is disposed at less than half of said first depth from said front plane.

10. The tray of claim 1, wherein said back surface and said front surface are configured so the back surface of one said tray is stackable with the front surface of another said tray.

11. The tray of claim 1, wherein said edge is generally rectangular and comprises a lower edge, an upper edge, and two opposing side edges extending between the upper and lower edges.

12. The tray of claim 11, wherein at least the first said compartment is a generally rectangular recess formed adjacent the lower edge and one of the side edges.

13. The tray of claim 12, said first compartment having a side wall including a keel adapted to abut a plane that passes through the lower edge and is generally perpendicular to the front plane.

14. The tray of claim 13, said first compartment containing a beverage.

15. The tray of claim 14, wherein the lower edge and the keel form a base wherein the weight of the beverage stored in said first compartment permits the container to be stood upright upon the base with the front plane being generally vertically oriented.

16. The tray of claim 1, further comprising internal and peripheral flanges located in said front plane, the flanges being of sufficient width that a flexible film can be sealed to them.

17. The tray of claim 16, wherein each of said compartments is defined by side walls extending down from the flanges to form a product receiving recess.

18. The container of claim 17, wherein the side walls defining the first compartment extend further down from the flanges than the side walls defining the remaining compartments.

19. The tray of claim 5, wherein said object is an eating utensil.

20. The tray of claim 5, wherein said object is selected from at least one knife, at least one fork, and combinations thereof.

21. A tray comprising:

(a) a front surface for supporting articles, said front surface being circumscribed by an edge which defines a front plane, wherein said edge is generally rectangular and comprises a lower edge, an upper edge, and two opposing side edges extending between the upper and lower edges;

(b) a back surface;

(c) at least first and second integral compartments formed in said front surface, projecting behind said front plane to a first depth, and respectively located adjacent to substantially diametrically opposed portions of said edge, said first and second compartments being the deepest compartments in said package and defining feet on said back surface for supporting said package on a horizontal surface with said front plane generally horizontal, wherein at least the first said compartment is a generally rectangular recess formed adjacent the lower edge, said first compartment having a side wall including a keel adapted to abut a plane that passes through the lower edge and is generally perpendicular to the first plane, wherein the lower edge and the keel form a base wherein the weight of a beverage in a container of predetermined dimensions stored in said first compartment permits the container to be stood upright upon the base with the reference plane being generally vertically oriented;

(d) said back surface of said tray being configured so that the first and second compartments of said tray can be nested laterally between the corresponding first and second compartments of another said tray when said trays are positioned back to back, allowing compact stacking of said trays.

* * * * *